US006408803B1

(12) United States Patent
Atkins

(10) Patent No.: US 6,408,803 B1
(45) **Date of Patent: *Jun. 25, 2002**

(54) LIQUID COOLING SYSTEM AND RETROFIT FOR HORIZONTALLY OPPOSED AIR COOLED PISTON AIRCRAFT ENGINES

(76) Inventor: Robert M. Atkins, 1413 Prospect Ave., Hermosa Beach, CA (US) 90254

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/693,757

(22) Filed: Oct. 19, 2000

(51) Int. Cl.[7] ..... F02F 1/10

(52) U.S. Cl. ..... 123/41.81; 123/41.47; 123/41.79; 123/55.2

(58) Field of Search ..... 123/41.81, 41.47, 123/55.2, 41.79

(56) References Cited

U.S. PATENT DOCUMENTS

| | | | | |
|---|---|---|---|---|
| 4,800 A | | 10/1846 | Perry | |
| 153,245 A | | 7/1874 | Daimler | |
| 240,708 A | | 4/1881 | Hill | |
| 247,741 A | | 10/1881 | Benier | |
| 605,405 A | | 6/1898 | Davis | |
| 679,410 A | | 7/1901 | Birdsall | |
| 1,316,912 A | | 9/1919 | Marschall | |
| 1,404,289 A | | 1/1922 | Harper, Jr. | |
| 1,423,365 A | | 7/1922 | Smith | |
| 1,660,706 A | | 2/1928 | Eversmann | |
| 1,725,121 A | | 8/1929 | Wintercorn | |
| 2,070,588 A | | 2/1937 | Geisse | |
| 3,815,557 A | | 6/1974 | Piech et al. | |
| 3,983,852 A | | 10/1976 | Chatourel | |
| 4,108,118 A | | 8/1978 | George | |
| 4,180,137 A | | 12/1979 | Wagner | |
| 4,388,979 A | | 6/1983 | Fritzenwenger | |
| 4,621,680 A | | 11/1986 | Funabashi | |
| 4,784,088 A | * | 11/1988 | Tamba et al. | 123/41.47 |
| 4,873,944 A | | 10/1989 | Yamada | |
| 4,917,052 A | * | 4/1990 | Eguchi et al. | 123/41.47 |
| 5,487,363 A | * | 1/1996 | Batzill et al. | 123/55.2 |
| 5,690,046 A | | 11/1997 | Grzech, Jr. | |
| 5,755,190 A | | 5/1998 | Ronen | |
| 5,806,491 A | | 9/1998 | Ohtake | |
| 5,954,016 A | | 9/1999 | Westerbeke, Jr. | |

FOREIGN PATENT DOCUMENTS

| | | | | |
|---|---|---|---|---|
| GB | 115837 | * | 4/1918 | 123/41.81 |
| GB | 490154 | * | 8/1938 | 123/41.81 |

* cited by examiner

*Primary Examiner*—Noah P. Kamen
(74) *Attorney, Agent, or Firm*—Natan Epstein

(57) ABSTRACT

A cooling system for conversion of air cooled aircraft engines to liquid cooling, including replacement cylinders, light weight, flex tolerant coolant manifolds and cooling system instrumentation for monitoring coolant temperature and pressure. The replacement cylinders have internal gating of coolant flow between a cylinder jacket and cylinder head exhaust port cooling passages for continuous high power operation of the engine.

42 Claims, 6 Drawing Sheets

32
38
36
122
30
34
124
28a
26a
28b
20
26b
24
12
22
12
12
100b
12
10
18
16
14
100a

LIQUID COOLING SYSTEM AND RETROFIT FOR HORIZONTALLY OPPOSED AIR COOLED PISTON AIRCRAFT ENGINES

BACKGROUND OF THE INVENTION

1. Field of the Invention

This invention relates generally to cooling systems for internal combustion engines and more particularly is directed to a liquid cooling system for and to the conversion of such engines from air cooling to liquid cooling.

2. State of the Prior Art

Many light aircraft in current service are powered by horizontally opposed piston engines. This type of engine is characterized by multiple pairs of piston cyclinders, each pair being mounted to opposite sides of a common crankcase block with all of the cylinders lying in a common horizontal plane. This type of engine is most notably exemplified by the Lycoming series of aircraft engines, and also certain engines made by Continental. The Lycoming engines are made in four cylinder configurations and to a lesser extent in six and even eight cylinder configurations, and are in widespread use in the civil aviation and light aircraft community. These engines have gained wide acceptance and have remained essentially unchanged since about 1955. For purposes of this disclosure reference is made primarily to Lycoming engines because these are the most prominent example of the type of engine to which this invention is directed. It should be understood, however, that the liquid cooling system and conversion according to this invention is not limited to any particular make or brand of engine, nor for that matter, to aircraft engines. Aircraft engines have discrete cylinders each individually bolted to a common crankcase block. This is distinguished from an in-block cylinder engine where the cylinders are contained in a common engine block.

The Lycoming engine in its original factory configuration is cooled by an air stream produced by the turning propeller driven by the engine. Air intakes defined by a cowling arrangement around the engine admit propeller driven air from the atmosphere into the engine compartment and over the piston cylinders on either side of the engine. The air heated through contact with the engine is discharged to the atmosphere through vent openings in the fuselage. Each piston cylinder includes a cylinder sleeve which contains a reciprocating piston and a cylinder head which is assembled to the outer end of the cylinder. The cylinder head closes the top or outside end of the cylinder and also carries the intake and exhaust ports and valves which control the flow of the air/fuel mixture into the cylinder and the hot exhaust gases out of the cylinder. The cylinder head also carries the spark plug or plugs which ignite the air/fuel mixture. A system of push rods external to the cylinders and driven by a crank turning in the engine block actuates the intake and exhaust valves on each cylinder through a rocker assembly in the cylinder head in time with an electrical ignition system which fires the spark plugs. The exterior surfaces of the cylinder and the cylinder head carry a series of annular radiator fins which greatly increase the metal surface exposed to the air stream and thereby enhance the transfer of heat from the cylinder to the air stream.

The Lycoming engine also has an accessory pad on the crankcase block with an output drive shaft which conventionally provides a power take-off for various accessories such as an engine governor or a propeller pitch drive.

Air cooling of aircraft engines has proved popular because it eliminates the weight and reliability issues of the radiator, pump and hoses of a liquid cooling system. On the other hand, air cooling suffers from a number of disadvantages as well. Firstly, air flow through the engine compartment and against the cylinders introduces significant drag, Secondly, cooling of the various cylinders is uneven, some receiving significantly better airflow than others depending of the position of each cylinder and the cowling configuration in the particular fuselage. Thirdly, air cooled Lycoming and similar aircraft engines operate at elevated temperatures, typically in the range of 400–500° F. and, although the engines are rated at 2000 hours before overhaul is needed, in actuality these engines have substantially shorter service lives. The conventional air cooled cylinder heads have a very large temperature differential across the head, between the intake valve and exhaust valve sides of the head. The intake side is cooled by the relatively cold air/fuel mixture flowing into the cylinder, while the hot combustion exhaust gases typically have a temperature of about 1500° F. The result is a differential of some 200° F. across the cylinder head, which often leads to cracking of the head within some 1100 hours of engine operation. This temperature differential can be reduced to about 25° F. by water cooling the cylinder head. Shock cooling of the cylinders may occur in a nose down descent with the engine running at idle, where rapid air flow can cause a rapid drop of 200° F. in cylinder head temperature while little heat is generated during idle operation, causing warpage of both the cylinders and the cylinder heads as one side shrinks relative to the other, the cylinders go out of round. Conversely, shock heating of 200° F. to as much as 400° F. of the cylinder head can happen during engine run-up prior to takeoff while the aircraft is stationary but developing high r.p.m. with little air flow over the engine. At temperatures of about 320° F. and above the aluminum alloy of the cylinder head looses T6 hardness and becomes more susceptible to cracking. Critical failures involving cracks developing in the cylinder heads and sticking of exhaust valve stems become more likely under such circumstances. Air cooling cannot sufficiently cool the exhaust valve area leading to carbonization of valve stem lubrication oil. These carbon deposits eventually lead to valve sticking. Also, repeatedly raising and lowering the aluminum alloy temperature induces work hardening of the metal and is also a factor leading to cracking of the cylinder heads.

Liquid or water cooling, on the other hand, is conducive to lower engine operating temperatures and more even cooling of all engine cylinders with lower air cooling drag. An estimated ten percent increase in air speed is obtainable by converting a given air cooled engine to liquid cooling, while at the same time reducing engine operating temperature to approximately 190° F. In turn, reduced engine temperatures permit an increase in engine compression ratio which translates into higher engine power output. Also, lower engine temperatures allows the engine to be run at lean fuel mix at low altitudes, even at sea level, without detonation and at higher power output than is possible with air cooling of the engine. A rich fuel mix, e.g. 19 gallons of fuel per hour (full rich), also operates to cool the engine, whereas a lean fuel mix such as 10 gallons per hour (a typical cruise lean mix) is more susceptible to detonation due to high engine temperature at oxygen rich low altitudes. Liquid cooling of the engine greatly reduces the chances of such detonation because of markedly lower combustion chamber surface temoertures.

A large number of light aircraft are in service with air cooled horizontally opposed piston engines which could benefit from conversion to liquid cooling. There is also a need for robust yet easy to install power plants in the experimental aviation, which presently relies on small, low power air cooled engines or, for higher power applications, on converted automobile engines which tend to be too heavy and run too fast for aircraft use. Heretofore, however, no conversion from air cooling to liquid cooling has received certification by the FAA because of the cost and difficulty of the certification process.

Many attempts have been made in the past to convert air cooled piston engines of various types to liquid cooling. However, because of the all important need for dependability in aircraft engines these attempted conversions have not found acceptance in the aviation industry, and only engines designed from the ground up for liquid cooling have found use in the aviation field.

Exemplary of past efforts at conversion to liquid cooling are the patents issued to George U.S. Pat. No. 4,108,118; Wintercorn U.S. Pat. No. 1,725,121; and Ronen U.S. Pat. No. 5,755,190. George provides a water cooled replacement for an air cooled cylinder, but retains the air cooled cylinder head. Further, the replacement cylinder is encompassed by a water jacket made up of two semi-cylindrical halves which require difficult and unreliable sealing to each other and to the cylinder sleeve. Wintercorn provides water cooling by fitting a cylindrical container over the air cooled cylinder sleeve and circulating liquid coolant through the enclosed space defined between the sleeve and the outer container. The outer container does not cover the cylinder head which remains air cooled. Also, this approach suffers from the same sealing problems as the George conversion and is unsuitable for aircraft use. Ronen describes a more comprehensive solution by replacing the cylinder head with a replacement head which features internal coolant passages and an integral jacket which extends over the cylinder sleeve. Nonetheless, the Ronen conversion still requires problematic sealing of the jacket to the cylinder sleeve. Yet another source of difficulty with each of the three prior patents is the possibility of electrolytic corrosion between the external water jacket and the cylinder sleeve if these two elements are of different metallic composition. These prior art patents also fall short in that problems specific to conversion of multi-piston engines and to providing adequate cooling to the very hot exhaust side of the cylinder heads are not addressed. Water manifolding and coolant circulation within the cylinder is key to successful water cooling of the cylinders in the aircraft engine. These and other shortcomings render prior attempts at conversion to liquid cooling unsuitable for implementation in aircraft power plants.

A continuing need exists for a reliable liquid cooling system for horizontally opposed piston engines useful for conversion of existing air cooled engines and also for implementation as original equipment in newly manufactured engines.

SUMMARY OF THE INVENTION

The present invention addresses the aforementioned need by providing a method and components for a liquid cooling system for horizontally opposed piston engines and particularly but not exclusively for Lycoming horizontally opposed piston aircraft engines.

In its broader aspect this invention provides a minimally invasive method of converting to liquid cooling a horizontally opposed piston engine having air cooled finned piston cylinders mounted to a common crankcase block and air cooled cylinder heads on the finned piston cylinders. The novel method involves the steps of detaching each of the finned piston cylinders from the crankcase block together with the air cooled cylinder heads and substituting therefor a liquid cooled replacement cylinder comprising a unitary casting including a double walled jacket defining an annular coolant cavity having an open end and an opposite end closed by a head portion having intake and exhaust ports, the head portion including coolant passages in fluidic communication with the annular coolant cavity, and a coolant inlet and a coolant outlet on the jacket for circulating coolant through the coolant cavity and the coolant passages, and a cylinder sleeve fitted to the open end of the double walled jacket; mounting a coolant pump on an accessory pad of the engine and connecting an accessory drive shaft of the accessory pad for driving the pump; providing a radiator; and interconnecting the pump, the radiator, and the coolant inlet and coolant outlet of each replacement cylinder to make a closed coolant circuit.

The method of this invention may also include the step of orienting each replacement cylinder relative to the crankcase block such that each coolant inlet is near a lowermost point along a circumference of the annular coolant cavity and each coolant outlet is near an uppermost point along a circumference of the annular coolant cavity on each of the horizontally opposed pistons, whereby coolant flow through the annular cavity of each replacement piston is in a generally upward direction from the coolant inlet to the coolant outlet and convective flow of coolant through the annular cavity is maintained in the event of failure of the pump to thereby delay overheating of the engine.

This invention also contemplates a liquid cooled internal combustion engine having plural pairs of horizontally opposed pistons, each piston displaceable in a piston cylinder external to a common crankcase block, the engine assembled with each piston cylinder having a unitary casting including a double walled jacket defining an annular coolant cavity having an open end and an opposite end closed by a head portion having intake and exhaust ports, the head portion including coolant passages in fluidic communication with the annular coolant cavity and arranged for directing coolant into thermal proximity with the exhaust ports and returning coolant to the annular coolant cavity, and a coolant inlet and a coolant outlet on the jacket for circulating coolant through the coolant cavity and the coolant passages; a cylinder sleeve fitted to the open end of the double walled jacket; a radiator; and a pump directly gear driven by an accessory drive shaft of the engine for circulating coolant liquid through the unitary casting of each piston cylinder and the radiator thereby to dissipate heat from the piston cylinders to the environment through the radiator. The liquid cooled engine has an accessory pad and an accessory drive shaft on the crankcase block, the pump being mounted to the accessory pad and driven by the accessory drive shaft. The pump further comprises a step-up gear assembly between a rotor of the pump and the accessory drive shaft whereby the pump rotor turns at higher speed than the accessory drive shaft.

A more particular aspect of this invention is a replacement cylinder for use in providing liquid cooling to an air cooled internal combustion engine of the type having one or more piston cylinders exterior to a crankcase block. The replacement cylinder features a unitary casting including a double walled jacket defining an annular coolant cavity having an open end and an opposite end closed by a head portion having intake and exhaust ports, the head portion including coolant passages in fluidic communication with the annular coolant cavity, and a coolant inlet and a coolant outlet on the jacket for circulating coolant through the coolant cavity and the coolant passages; and a cylinder sleeve fitted to the open end of the double walled jacket. Preferably the cylinder sleeve is threaded to the unitary casting, the cylinder sleeve and unitary casting are of materials having dissimilar coefficients of thermal expansion, and the cylinder sleeve and unitary casting are fitted to each other in a compressive interference fit by differential thermal expansion. In the preferred for of the invention the cylinder sleeve and the unitary casting are threaded to each other and permanently joined in a fluid tight interference fit resulting from differential thermal contraction during cooling following hot assembly of the two parts. The unitary casting is preferably of aluminum and the cylinder sleeve is of steel.

The double walled jacket of the unitary casting has an outer wall and an inner wall both joined to the head portion and further joined along a common bottom, the annular coolant cavity being defined between the outer wall and the inner wall, with the inner wall being in thermal contact with a substantial portion of the cylinder sleeve such that coolant liquid circulating through the cavity cools the cylinder sleeve without coming into contact with the cylinder sleeve, whereby electrolytic corrosion is avoided between the casting and sleeve of dissimilar metals.

The double walled jacket may have interior fluid gating configured for diverting a substantial portion of coolant liquid entering the inlet into the coolant passages of the head portion thereby to provide liquid cooling to the exhaust port portion of the cylinder head. The fluid gating may preferentially divert coolant entering the jacket inlet into the head coolant passages over the annular coolant cavity.

It is preferred that the coolant inlet be near a lowermost point along a circumference of the annular coolant cavity and that the coolant outlet be near an uppermost point along a circumference of the annular coolant cavity on each of the horizontally opposed pistons, whereby coolant flow through the annular cavity is in a generally upward direction from the coolant inlet to the coolant outlet and convective flow of coolant through the annular cavity is maintained in the event of failure of the coolant pump thereby to delay overheating of the engine.

Yet another aspect of this invention is a cooling system instrumentation system and display having:

a) a temperature indicator driven by a temperature sensor in thermal contact with the coolant liquid;

b) an actual water pump outlet pressure indicator driven by an input signal representative of the difference between an instantaneous pump outlet pressure and a coolant static or system pressure measured at a point downstream from the pump and upstream of the engine; and c) a low coolant indicator actuated by a signal representative of a relatively low coolant system pressure coupled with a relatively high coolant temperature.

The point downstream may be at a thermostat connected downstream of the pump for controlling coolant flow through or for bypassing the radiator, and the relatively low coolant system pressure is desirably an adjustable pressure. For example, the relatively low coolant system pressure may be a pressure lower than 5 psi and the relatively high coolant temperature may be greater than 160° F.

Still another aspect of the liquid cooled engine according to this invention is a coolant manifold comprising a T-fitting including a center tube attached to each coolant inlet and coolant outlet of the double walled jacket of the unitary casting, and a cross tube open at opposite ends; a ring seal at each of the opposite ends, a connecting tube inserted into the ring seals of mutually facing open ends of adjacent ones of the piston cylinders, and a hose connected to a first one of the cross tube ends and a plug closing a last one of the cross tube ends, one hose being connected to an outlet of the pump for delivering coolant to the cylinders, the other hose being connected for returning hot coolant to a thermostat. Preferably the T-fittings and the connector tubes are made of aluminum for lightweight.

DETAILED DESCRIPTION OF THE PREFERRED EMBODIMENTS

This invention provides a liquid cooling system which may be installed as a retrofit on existing air cooled engines and may also be installed as factory original equipment on newly manufactured engines. The cooling system is modular in nature and is easily expandable from a four cylinder engine to six and eight cylinder engines. For purposes of the following explanation the engine is a standard four cylinder parallel valve Lycoming O-360-A4A engine. The cooling system can be readily expanded for installation in a six cylinder Lycoming O-540 engine, an eight cylinder Lycoming O-720, as well as other engines. Liquid cooling and water cooling are interchangeable terms for purposes of this disclosure. The preferred coolant liquid is a 50:50 mixture of water and an antifreeze compound such as Ethylene Glycol or Polyethylene Glycol.

Figure 2:
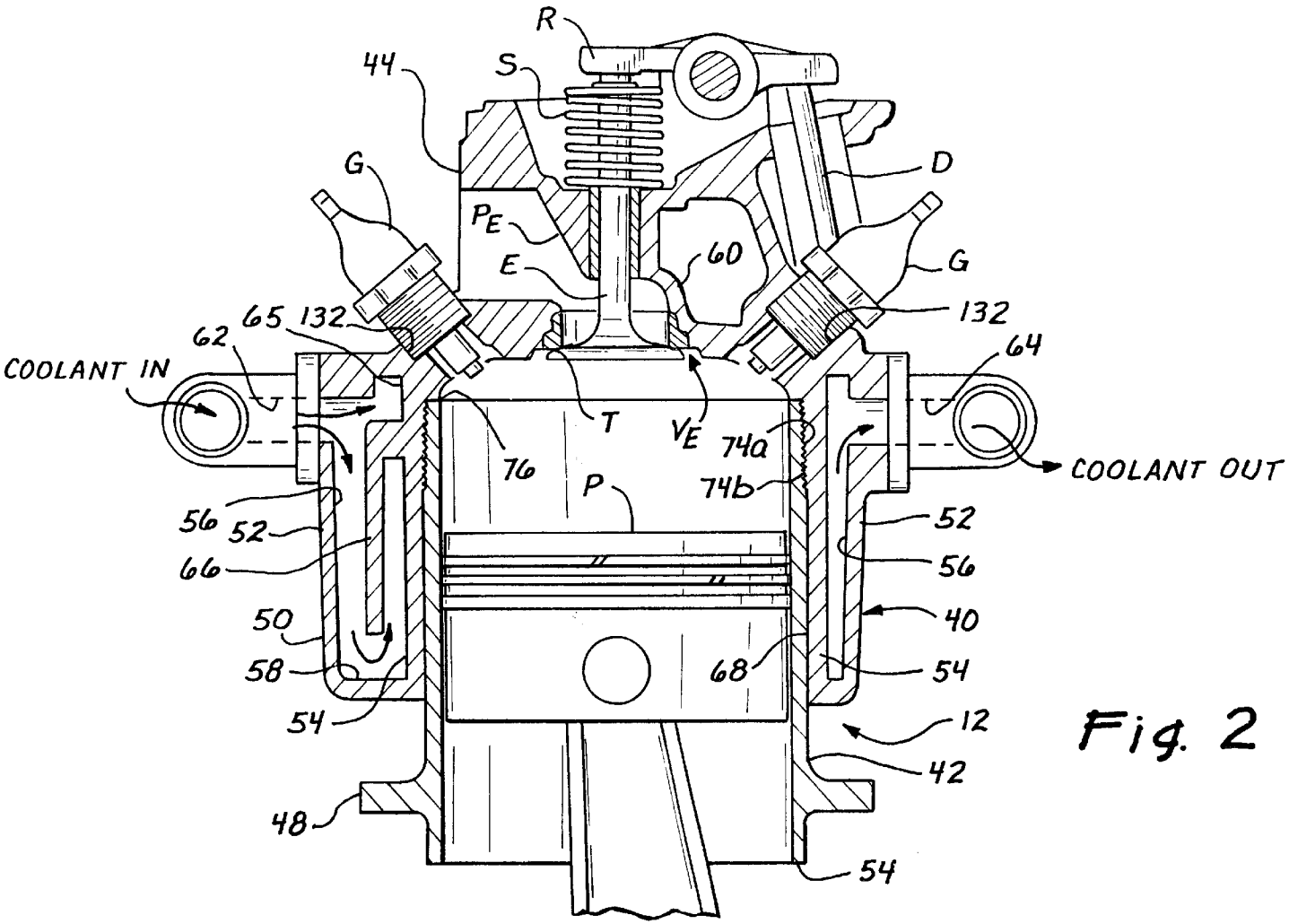
FIG. 2 is a vertical cross section of one piston cylinder of the engine of FIG. 1 showing the sealed water jacket integral with the cylinder head casting and the cylinder sleeve assembled to the head casting to make up the liquid cooled replacement cylinder. The coolant inlet is on the left and the coolant outlet is on the right hand side of the drawing. The Figure also shows the two spark plugs on the cylinder head and one of the valve stems with its valve spring, rocker arm and push rod. The cylinder and part of the crank arm are seen in the cylinder sleeve.

In the conventional air cooled Lycoming O-360-A4A engine each cylinder and cylinder head has exterior radiator fins which provide a large surface exposed to the stream of cool air for better dissipation of engine heat. The cylinder is formed as a unitary aluminum casting with its radiator fins, and the cylinder head is likewise made as a unit machined of steel with its own set of integral radiator fins. The finned cylinder head is screwed onto one end of the cylinder sleeve in an interference fit by hot assembly so that the two parts of dissimilar metals are locked after cooling, and the other end of the finned cylinder sleeve is bolted to the engine block. The finned head includes a set of intake and exhaust valves which alternately admit air/fuel mixture into the cylinder and then vent the hot gases resulting from combustion of the mixture which is ignited by spark plugs G also mounted on the cylinder head. Each valve consists of a valve stem E which reciprocates axially within the intake or exhaust port and has a valve head at one end of the stem which seats against a valve seat surface T to close the port opening. The valve stem is biased to an open or closed condition by a coil spring S coaxial with the valve stem. A valve train mechanism, which includes a rocker arm R actuated by a push rod D which in turn is driven by a cam shaft turning within the engine block. The elements designated by the capitalized letters above are common to the liquid cooled engine and are shown in FIG. 2. It is understood that each cylinder has one exhaust port and one intake port, each with a corresponding valve and valve train, all of which are transferred from the air cooled to the liquid cooled cylinders without modification. The cam shaft is geared to the crank shaft which is turned by the reciprocating action of pistons in the several cylinders acting through crank arms. The turning cam shaft acting through the valve trains alternately opens and closes the intake and exhaust valves, admitting fresh air/fuel mixture and venting hot exhaust from the cylinders. The forward end of the crank shaft extends from the engine block to provide the main drive shaft of the engine which turns the propeller of the aircraft.

The design and operation of the various moving parts of the liquid cooled engine according to this invention is conventional and remains unchanged during conversion of the engine from air cooling to liquid cooling, and for this reason the operation of the engine need not be described in greater detail here.

Figure 1:
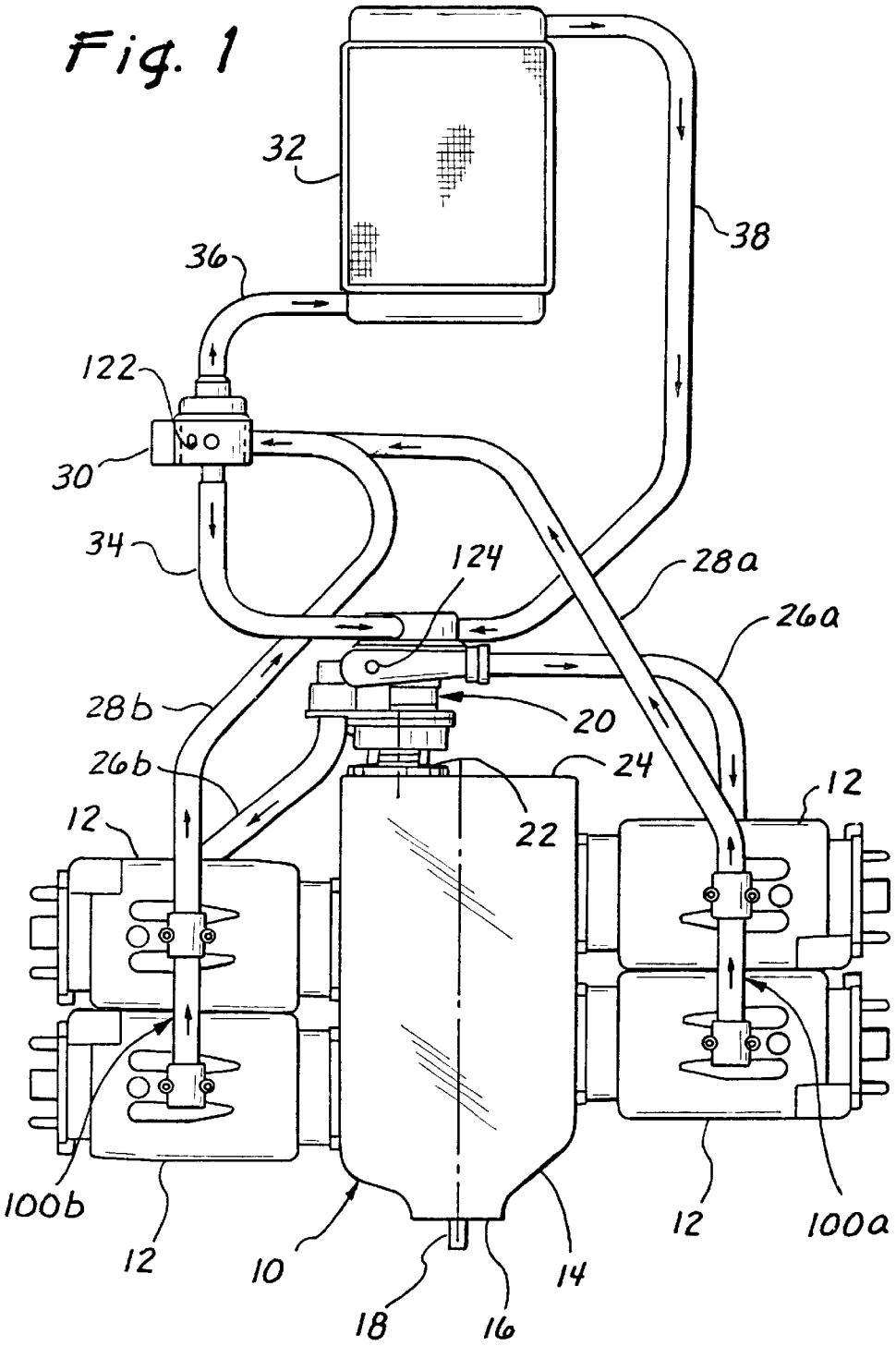
FIG. 1 depicts in top plan view a liquid cooled horizontally opposed piston engine equipped with the liquid cooling system of this invention.

With reference to the accompanying drawings wherein like elements are designated by like numerals, FIG. 1 shows a liquid cooled engine such as a 4 cylinder Lycoming O-360 engine, generally designated by the numeral 10 and which includes four cylinders 12 mounted in horizontally opposed left and right banks or pairs to a common crankcase block 14. The cylinders are shown without the head covers which normally cover the outer ends of the cylinders and are stripped of the valve trains for ease of illustration. The crankcase block has a front end 16 from which projects a main drive shaft 18 to which is normally mounted an aircraft propeller (not shown). A coolant pump 20 is mounted to an accessory pad 22 on the rear end 24 of the engine block 14. The pump has two outlets for driving coolant through supply hoses 26*a*, 26*b*. Each supply hose delivers coolant to a corresponding left or right cylinder bank. Return hoses 28*a*, 28*b* return hot coolant front the respective left and right cylinder banks to a thermostat 30 which, depending on coolant temperature, directs the coolant either back to the pump 20 through bypass hose 34 for recirculation to the cylinders or through radiator hose 36 to a radiator 32 for cooling and subsequent return through hose 38 to pump 20, which then again delivers the coolant to the engine cylinders through supply hoses 26*a*, 26*b* thus completing the closed coolant circuit.

Each of the principal components of the engine cooling system will now be described in greater detail below.

I. The Liquid Cooled Cylinders

Figure 3:
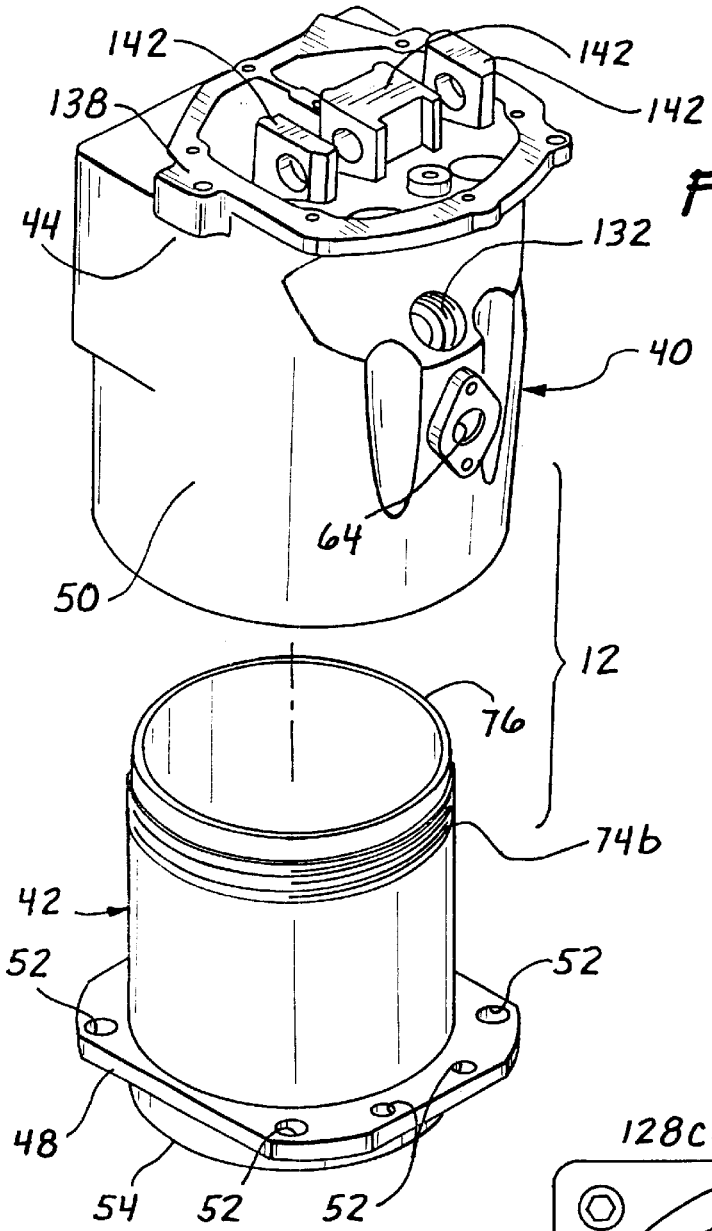
FIG. 3 is an exploded perspective view of the liquid cooled cylinder assembly, showing the replacement cylinder head casting axially spaced from the replacement cylinder sleeve.

Conversion of the conventional air cooled engine to liquid cooling requires that each of the conventional air cooled finned piston cylinders and cylinder heads be removed and replaced by a liquid cooled cylinder assembly 12 depicted in FIGS. 2 and 3. The liquid cooled cylinder assembly 12 includes a replacement cylinder head casting 40 assembled to a replacement cylinder sleeve 42.

The head casting 40 includes a cylinder head portion 44 formed integrally with an annular coolant jacket 50. The head portion 44 essentially follows the structure of the original finned cylinder head in so far as the location and dimensions of the various intake and exhaust ports, valve stem guides, spark plug mounting holes, push rod guides and supports, and mounting flanges for head covers. The entire valve train and spark plug arrangement in the liquid cooled head casting 40 is the same as in the air cooled cylinder head, and the valve train components and spark plugs are interchangeable between the air cooled and the liquid cooled cylinder heads. Likewise, the original fuel inlet lines and cylinder exhaust manifolds of the air cooled engine fit the corresponding opening on the liquid cooled cylinder head casting 40.

As best seen in FIG. 2 the head casting 40 has an integral coolant jacket 50 unitary with the head portion 44. The coolant jacket is a double walled jacket including a radially outer jacket wall 52 and a radially inner jacket wall 54 defining between them an annular, generally cylindrical coolant cavity 56 which extends fully around the circumference of the piston cylinder. The inner and outer walls of the double walled jacket 50 are both joined along their upper ends to the head portion 44 of casting 40 and are also joined to each other along a common jacket bottom 58, thereby forming a closed annular, generally cylindrical container for the liquid coolant.

The interior of the head portion 44 is traversed by multiple internal coolant ducts 60 formed in the casting process. The coolant ducts 60 are of complex manifold geometry not readily depicted in two dimensional drawings, and FIG. 2 shows a cross section of only one such duct 60. However, the precise geometry of the head coolant ducts 60 is not critical to the invention, and it suffices that sufficient coolant flow capacity be provided through the head portion 44, particularly near the exhaust port $P_E$ and exhaust valve $V_E$ as this is the side of the cylinder head which is hottest during engine operation. The intake side of the head portion 44 is partially cooled by the air/fuel mixture flowing into the cylinder and requires less coolant flow.

The coolant jacket 50 has one coolant inlet 62 and one coolant outlet 64 at approximately diametrically opposed locations around the jacket, each terminated at a flat surface on the exterior of the cylinder with screw holes for fastening the mounting flange of the T-fitting of the respective supply and return coolant manifolds, as will be explained below. The head coolant ducts 60 are in fluidic communication with the interior of the annular coolant jacket 50, i.e. with the annular coolant cavity 56. This fluidic communication is internal to the casting 40 and includes an internal inlet 65 only partially shown in FIG. 2 for admitting coolant from jacket inlet 62 into the head coolant ducts 60 and an internal outlet for discharging hot coolant from the head coolant ducts 60 into the coolant cavity 56 at a location near the jacket coolant outlet 64. The interior inlet and outlets to the head coolant ducts 60 are not shown in the drawings but their location can be adequately determined from this description. An important feature is an interior flow gate 66 located inside coolant cavity 56 adjacent to the inlet 62 and configured so as to divert a substantial portion of the coolant inflow from inlet 62 to the head coolant ducts 60, and even to direct the inflow of coolant preferentially to the head coolant ducts 60 over the annular jacket cavity 56, to provide adequate cooling to the exhaust side of the cylinder head 44. As a guideline, about 65% of the coolant flowing to the cylinder 12 through inlet 62 is diverted by the flow gate 66 into the head cooling ducts 60, with the balance flowing into the jacket cavity 56.

The coolant jacket portion 50 of the head casting 40 has a cylindrical bore with an inner surface 68, an open bottom end 72 and an opposite upper end closed by the head portion 44 of the casting. A screw thread 74*a* is cut near the upper end 76 of the replacement sleeve, and a mating interior thread 74*b* is cut in the interior surface 68 of the jacket 50. The interior diameter of the cylindrical surface 68 is slightly undersized, e.g. by approximately 0.005 inch, to the exterior cylindrical surface of the replacement cylinder sleeve 42. The two different metals have different coefficients of thermal expansion. The aluminum alloy head casting 40 expands to a greater degree than the steel sleeve 42. The steel sleeve 42 is assembled to the casting 40 by bringing the two elements to a temperature of approximately 300° F., such that the head casting 40 expands sufficiently to accept the diameter of the sleeve 42 inside the open bottom of the cylindrical bore of coolant jacket 50 and permit the sleeve thread 74*a* to mate with the internal thread 74*b* of the casting. After the replacement sleeve and the replacement head casting cool to a lower temperature the two parts become joined in an interference fit and are locked together in a fluid tight cylinder assembly 12 at the mated threads 74*a,b*. During normal engine operation the cylinder assembly 12 is subjected to temperatures lesser than the 300° F. assembly temperature, so that the cylinder assembly is effectively permanent. The replacement head casting 40 is cast in A356 aluminum alloy and then heat treated to T6 hardness. The water jacket/cylinder head assembly may then be "Wisodized", a process similar to anodizing but which offers improved protection against corrosion and surface hardening resulting in low porosity. The replacement sleeve or cylinder liner 42 is machined of 4140 steel heat treated to a Rockwell hardness in the range of 28 to 32.

The replacement sleeve 42, best seen in FIG. 3, is dimensioned and configured to receive the existing piston head P, as shown in FIG. 2, of the original engine and has a mounting flange 48 near the lower end 54 of the sleeve with bolt holes 52 located to match the existing bolt holes on the engine block 14. Consequently, installation of the liquid cooled cylinders 12 involves nothing more than substitution of cylinder assembly 12 for the air cooled cylinders and cylinder heads of the engine and does not require any modification to the engine block nor to any of the original moving parts of the engine.

FIG. 2 illustrates how the inner wall 54 of the coolant jacket is in close mechanical and thermal contact with a substantial portion of the cylinder sleeve 42, such that coolant liquid circulating through the cavity 56 takes up heat through the thermally conductive aluminum of jacket 50 and thereby cools the cylinder sleeve 42. An important point to note is that the coolant liquid is at all times contained in the aluminum casting 40 and never comes into contact with the steel sleeve 42. This isolation of the liquid coolant eliminates a source of galvanic or electrolytic corrosion between the dissimilar metals of the casting 40 and the sleeve 42.

The jacket inlet and jacket outlet 62, 64, of coolant jacket 50 are located such that, when the cylinder assembly 12 is assembled to the engine block 14, the coolant inlet 62 is near a lowermost point along a circumference of the annular coolant cavity 56 and the coolant outlet 64, generally diametrically opposed to inlet 62, is near an uppermost point along the same circumference of the annular coolant cavity on each of the horizontally opposed pistons of the engine 10. That is, the coolant outlet 64 is well above the coolant inlet 62 on each coolant jacket 50 so that as hot coolant tends to rise against gravity by natural convection in the jacket cavity 56 it tends to rise towards and into the outlet 64 while at the same time drawing fresh coolant through the inlet 62 into the jacket cavity 56. This generally upward direction of flow from the coolant inlet 62 to the coolant outlet 64 is aided by convective upward flow of hot coolant through the annular cavity 56. This convective flow continues even if forced circulation of the coolant is interrupted, as in the event of failure of the coolant pump 20, and thereby delays, however slightly, overheating of the engine. In an emergency even a few seconds of additional engine power can provide a safety margin sufficient to make the difference between a survivable landing and a crash.

Figure 5:
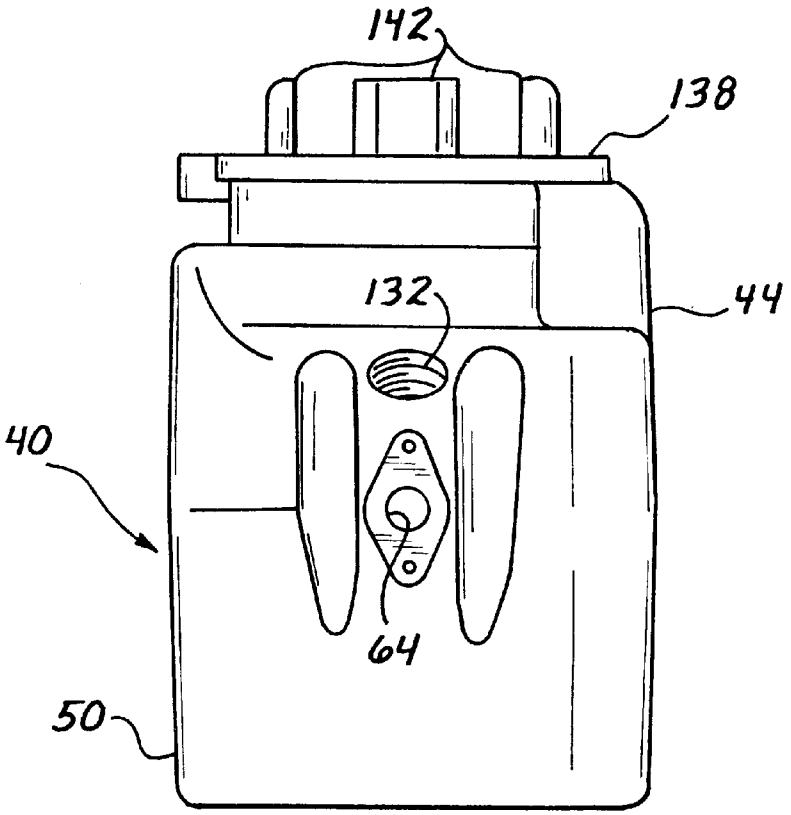
FIG. 5 is a side view of the cylinder head casting of FIG. 4 seen on its diametrically opposite coolant outlet side.
Figure 4:
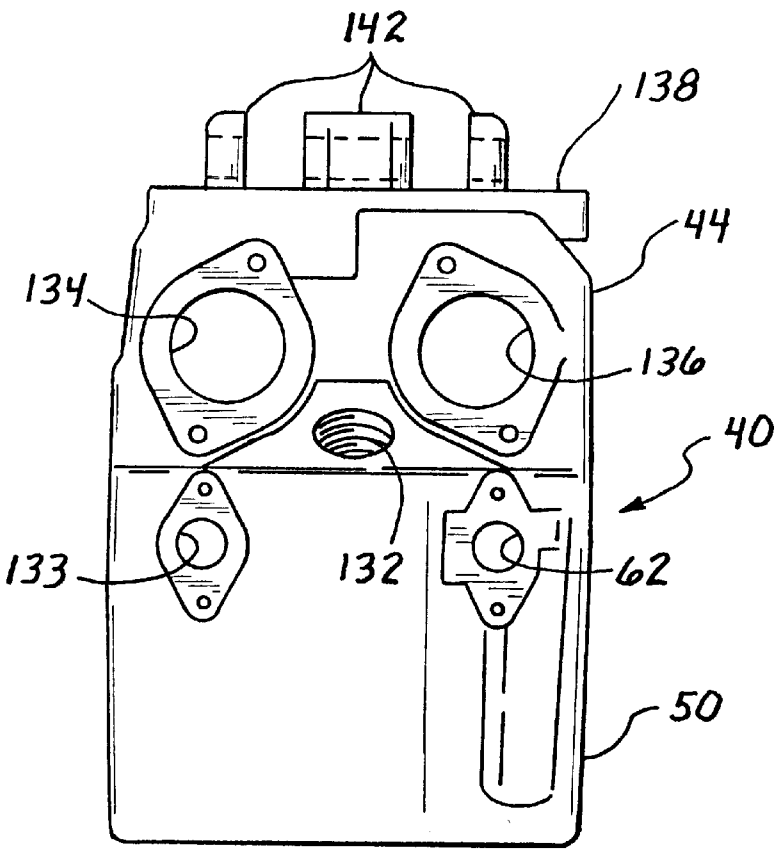
FIG. 4 is a side view of a cylinder head casting seen on the coolant inlet side.
Figure 6:
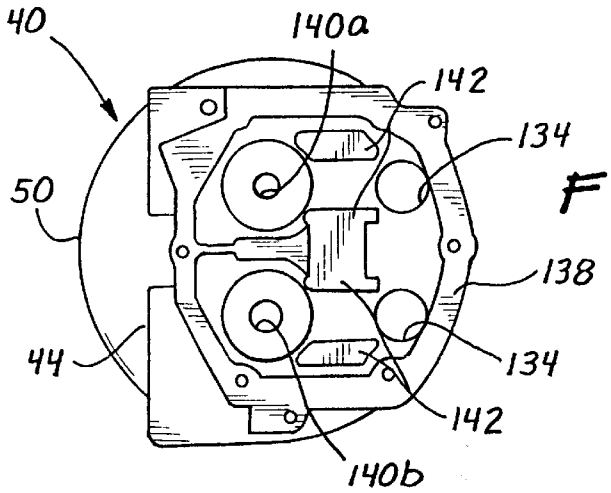
FIG. 6 is a top plan view of the cylinder casting of FIG. 4 showing the inlet and outlet ports of the cylinder head and the two spark plug mounting holes.

FIGS. 4, 5 and 6 are different exterior views of the cylinder head/cooling jacket castings 40 and show the two spark plug openings 132, one intake port 134, one exhaust port 136, coolant jacket inlet 62, coolant jacket outlet 64, head cover mounting flange 138, intake valve stem guide 140*a*, exhaust valve stem guide 140*b*, and push rod through holes 134 for passing the two push rods D which actuate the rocker arm R as part of the conventional valve train. The opening 133 shown in FIG. 4 is closed with a cover screwed to the surrounding flat area, and is made as a byproduct of the casting process which requires a support in that location for the sand core used to create the interior passages and cavities in the casting 40.

II) The Pump and Pump Drive Gear Box

Figure 8:
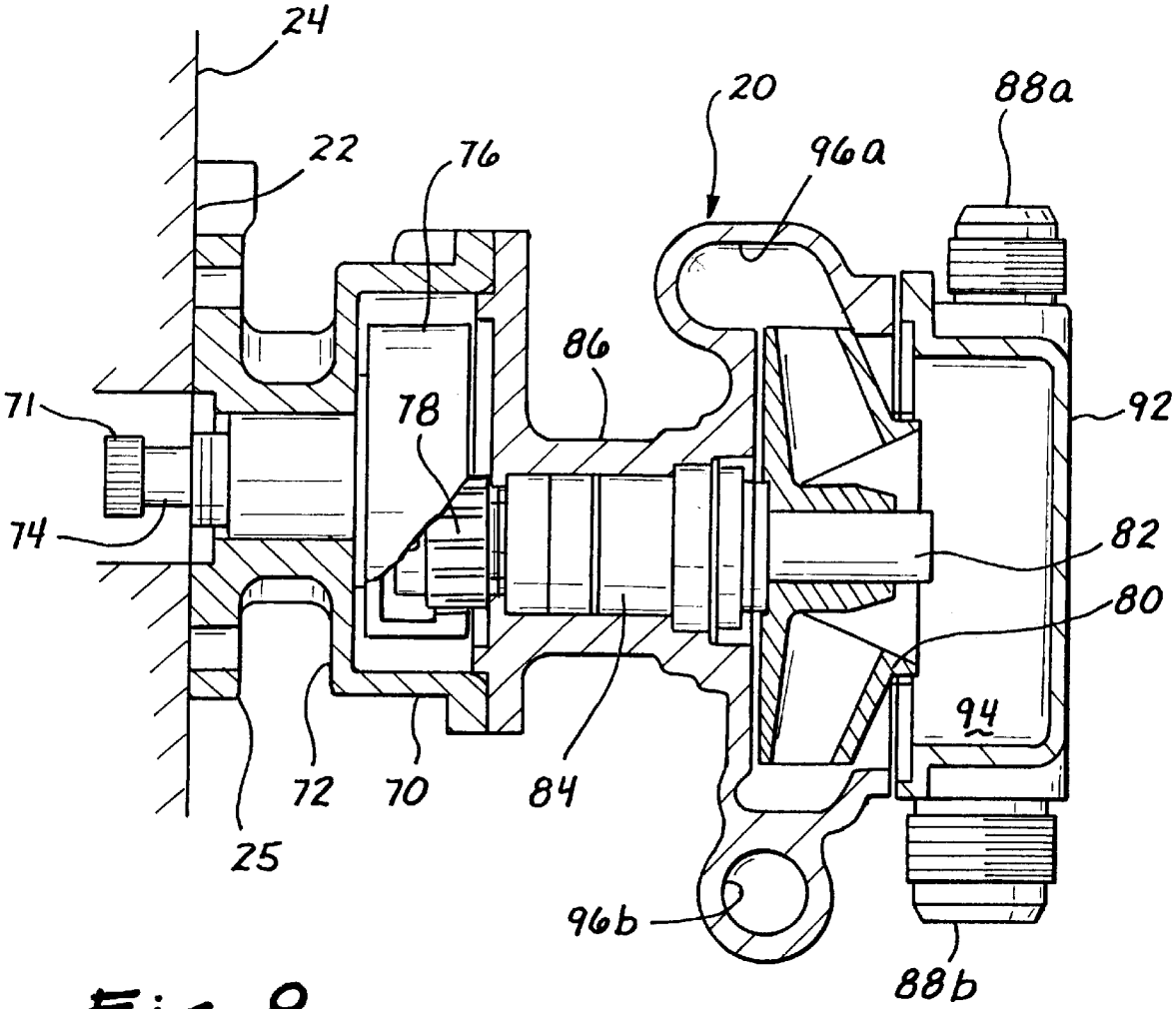
FIG. 8 is a longitudinal cross section of the coolant pump mounted to the accessory pad through a speed step-up gear box.

Forced circulation of liquid coolant is provided by a coolant pump 20 which is a high volume, high pressure rotary impeller pump depicted in FIG. 8. The pump is of axial configuration and designed to deliver a coolant flow of about 33 gallons per minute at a pressure of 30 to 40 lbs/sq. inch. The total volume of coolant in the system is between 2 and 3 gallons of fluid, which represents a weight of about 16 to 24 pounds (at 8 lbs. per gallon of coolant). This is a high pressure and high rate of flow compared to typical coolant pumps in other liquid cooled engines, and compares to coolant flows and pressures found in high performance auto racing engines. Proper selection of pump pressure and flow rate capacity is essential to successful operation of the liquid cooling system.

The pump 20 is driven off of an accessory pad 22 which is conventionally provided on the Lycoming engine block. On a Lycoming O-360 or O-540 engine this accessory pad is commonly referred to as the governor accessory pad and, when looking directly at the rear of the engine block 14 it is the lower right accessory pad. The existing accessory pad 22 provides an output drive shaft D which, however, turns at a relatively low speed for the purpose of operating various accessories such as an engine speed governor or a propeller pitch drive. For purposes of driving the coolant pump 20 output speed of the accessory pad is too slow, and is raised to a higher r.p.m. by means of an intervening gear drive 70, also seen in FIG. 8. In the Lycoming O-360 3ngines the drive shaft of the governor accessory pad turns at a ratio of 0.89:1 relative to engine rpm, while on the O-540 engine the ratio is 1.35:1. It has been found that the pump 20 must turn at approximately 5,000 rpm in order to produce the necessary coolant pressures and low rates. The gear drive 70 includes a gear box or housing 72 which is bolted to engine block 14. An input shaft 74 is axially connected for rotation with the accessory pad drive shaft D. A larger diameter driving gear 76 on input shaft 74 is in mesh with and turns a smaller diameter driven gear 78 mounted on impeller shaft 82. Shaft 82 is supported on bearings 84 to the pump housing 86 and drives an axial vane impeller 80. The speed of rotation of the impeller 80 is greater than the speed of the accessory drive shaft D by a ratio equal to the radius of driving gear 76 divided by the radius of the driven gear 78. It has been found that a gear ratio of 1.80:1 relative to the accessory drive speed provides adequate pump speed. Installation of the pump 20 retains use of the existing internal idler gear of the accessory pump so that no internal modification to the engine is require by the pump. The front end of the pump housing 86 is closed by cover 92 which carries two coolant inlets 88*a*,88*b* opening into an intake chamber 94. The impeller draws coolant liquid from chamber 94 and drives the coolant radially outwards at high pressure towards two coolant outlets 96*a*, 96*b* on the pump housing 86.

III) The Thermostat

Thermostat 30 in FIG. 1 as installed in a prototype engine is a commercially available unit sold as a Robert Shaw model 354-190. This is an automotive style thermostat but of the balanced sleeve type rather than the more common poppet type. The latter is susceptible to jamming in high pressure cooling systems because the thermostat opens against the coolant pressure, which is not the case with balanced sleeve designs. Also, balanced sleeve thermostats provide much greater flow rates than poppet type thermostats.

The purpose of the thermostat is to route hot return coolant from the cylinders either directly back to the intake of the water pump via bypass hose 34 or to the radiator 32 for cooling. During engine warm-up at coolant temperatures below 190° F. the thermostat remains closed causing the coolant to be returned directly to the pump intake. As the coolant reaches 190° F. the thermostat opens gradually directing an increasing percentage of coolant to the radiator while at the same time gradually restricting bypass flow to the pump intake. The thermostat housing is preferably machined of an aluminum alloy and treated with an anti-corrosive finish. The hose fittings may be of heat treated aluminum alloy with 37° AN type hose fittings.

IV) The Radiator

The radiator 32 in FIG. 1 may be a radiator of conventional design and will normally be selected and configured to suit the cowlings or belly location on the airframe of the particular aircraft.

V) The Coolant Manifolds and Hoses

The coolant forced by the pump 20 is carried by hoses 26*a*,26*b* to left and right coolant inlet manifolds respectively. The inlet manifolds in turn deliver the coolant to the coolant inlet 62 of each cylinder assembly 12. The hot coolant returns from the cylinders 12 via return manifolds 100*a*,100*b*, seen on top of the cylinders 12 in FIG. 1. The inlet manifolds are similar to the return manifolds but are hidden under the cylinders 12 in FIG. 1. Each inlet manifold supplies coolant to the coolant inlets 62 of each cylinder 12 of a corresponding left or right bank of two cylinders 12, while each return manifold returns hot coolant to thermostat 30 from coolant outlets 64 of each cylinder in a corresponding left or right bank of two cylinders 12.

Figure 7:
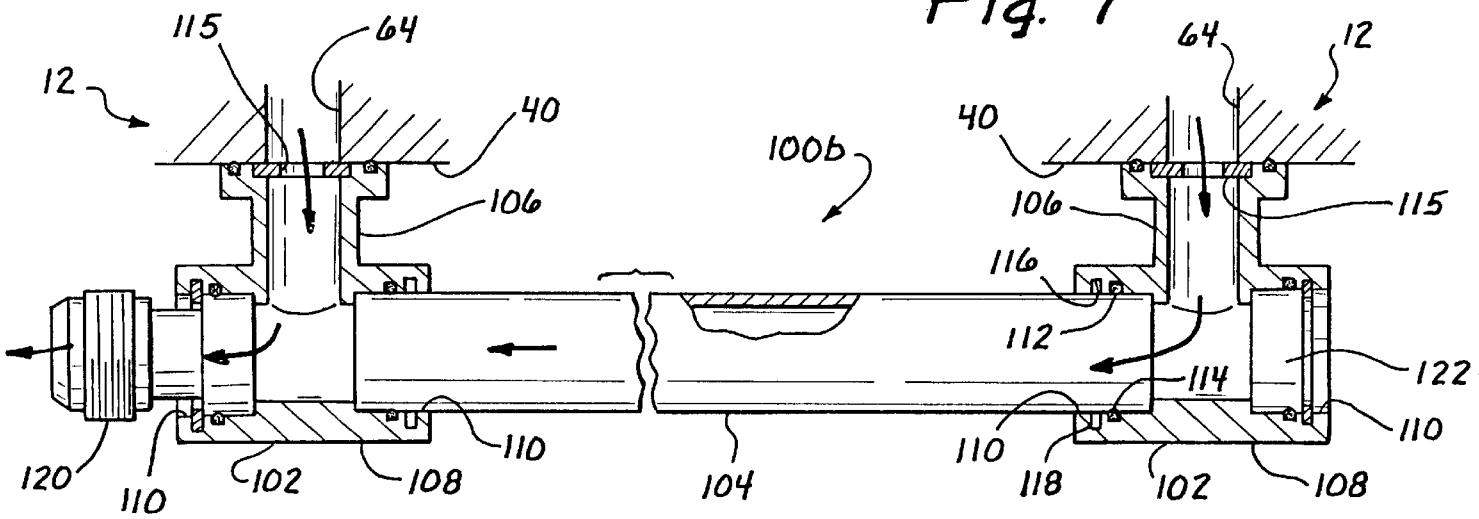
FIG. 7 is a view partially in cross-section of one coolant manifold connected to the coolant outlet of two cylinders on one side of the crankcase block of the engine of FIG. 1.

FIG. 7 shows in greater detail the construction of a coolant outlet manifold 100*b* which consists of two T-fittings 102 joined by a connector tube 104. Each T-fitting 102 has a center tube 106 attached to the coolant outlet 64 in the coolant jacket 50 of a corresponding cylinder 12, and a cross tube 108 open at two opposite ends 110. Each end 110 of the cross tube has a first interior annular groove 112 for accepting an elastomeric O-ring 114 and a second interior annular groove 116 for retaining a metallic snap-ring 118 which serves as a mechanical retainer for the end fittings including a hose connector 120 and an end plug 122. The connector tube 104 interconnects two mutually facing open ends 110 of the two T-fittings 102 of each manifold. An O-ring 114 seals each end of the tube 104 to the corresponding T-fitting 102, but the connector tube 104 is not otherwise retained by any snap ring nor other fastener to the T-fittings and is simply held captive between the two T-fittings. In effect the tube floats on the O-rings between the two T-fittings. The end plug 122 closes the outward facing end opening 110 of the last T-fitting 102 of the manifold, while hose connector fitting 120 provides a coupling for a coolant hose to the first end opening 110 of the first T-fitting 102 on the left side of of the manifold in FIG. 7. Hose coupling 120 has a 37° AN male fitting to accept a matching AN female fitting on the coolant hose. Preferably, the T-fittings 102 and the connector tubes 104 are made of 6160 aluminum alloy for light weight. However, stainless steel tubing may be substituted for more demanding environments. Coolant flow through the jacket outlet 64 of each cylinder 12 is restricted by a smaller aperture restriction washer 115 sufficiently to assure a relatively high coolant pressure inside the various conduits and cavities of the head casting 40. This is in order to reduce the likelihood of flash boiling of the coolants in the very hot exhaust side of the cylinder head 44. To this end it is desirable to maintain coolant pressure of some 40 psi in the coolant ducts 60 of the casting. This compares with typical pressures of 5 psi in most liquid cooled engines. At the same time, a high rate pf coolant flow is maintained by pump 20 of 33 gallons per minute for the four cylinder engine. The aperture of restriction washer is selected to increase coolant pressure at the pump outlet to about 40 psi. This pump pressure is added to the static coolant pressure of about 15 to 18 psi in the closed system due to heating of the coolant to engine operating temperature of about 190° F. The coolant system may be provided with a 20 psi pressure cap at the thermostat housing. The sum of the pump outlet pressure and static coolant pressure of about 50 to 60 psi ensures a high coolant pressure inside the cylinder head coolant passages 60, thereby to prevent flash boiling of the coolant in the critical exhaust area of the cylinder head 44. The high coolant pressure also increases the thermal conductivity of the coolant. The pumo pressure without the flow restriction washer 115 would be approximately 20 psi at a flow rate of some 50 gallons/minute. It should be noted that the restriction washer is installed only on the coolant return manifolds 100*a*,100*b* and not in the coolant supply manifolds. The impeller 80 of the coolant pump 20 is selected and configured for generating the aforementioned coolant pressures and flow rates.

The floating connections of the opposite ends of connector tube 104 to the T-fittings permit slight movement of the tube's longitudinal axis approximately 2 or 3 degrees away from coaxial relationship with the cross tube 108 without breaking fluid tight sealing of the O-ring 114 nor release of snap ring 116. This feature is important because the engine block 14 is subject to severe torsional forces during normal flight of the aircraft, arising from interaction between the gyroscopic inertia of the propeller on the engine shaft and the lateral forces imposed on the engine block when the airframe is steered left or right by the rudder on the tail of the aircraft. The propeller constitutes a 50 to 100 lb. mass rotating at speeds from a few hundred to some 2,700 r.p.m and generates a sizable moment of angular inertia against any change in the plane of rotation of the propeller. Rudder and elevator action operate to turn the airframe along with the engine block, while the angular inertia of the rotating propeller mass resists such turning. The interaction of these forces causes the engine block to flex laterally left or right, or flex up and down to a degree sufficient to increase or decrease the spacing between the outer ends of the cylinders. In addition to these gyroscopic torsional forces the entire engine block 14 expands and contracts with changes in engine temperature, also changing the distance between the cylinders. These changes in cylinder spacing are slight, but must be accounted and allowed for if the coolant manifolds are to be safeguarded against leakage and eventual failure.

The several coolant hoses 26*a*,26*b*,28*a*,28*b*,34,36,38 mentioned earlier in connection with FIG. 1 and which interconnect the various components and complete the coolant circuit are high pressure AN aircraft qualified flexible hoses rated at 250 psi or higher burst pressure with 37° AN type hose fittings at each end of the hoses.

VI) Instrumentation of the Liquid Cooling System

The liquid cooling system may be equipped with an instrumentation system and display which can provide useful information regarding the status and operation of the cooling system and thus contribute significantly to the safe operation of the aircraft. The most important data to the aircraft pilot is coolant temperature as a general indication of acceptable engine and cooling system operation; coolant pressure as an indication of the integrity of the various conduits which make up the cooling system, and verification of pump operation to confirm that coolant is being circulated through the system. Also desirable is the ability to set or adjust trigger points for each of these three factors for triggering a visual or audible alarm in the event of an abnormal condition with respect to any of these aspects of the engine cooling system.

The instrumentation includes a coolant temperature sensor 122 which may be mounted on the housing of thermostat 30, a pump output sensor 124 mounted on the pump housing for sensing coolant pressure at the pump outlet, and a coolant system pressure sensor 126 also mounted on the thermostat housing, downstream from the pump outlet pressure sensor.

Figure 9:
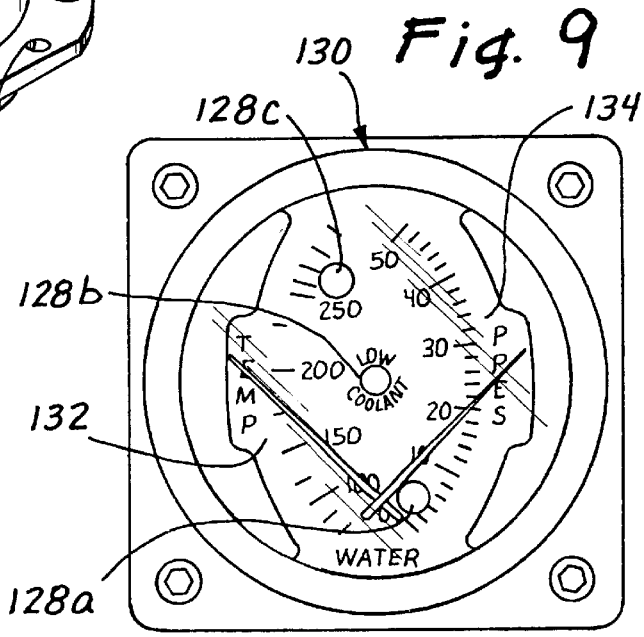
FIG. 9 shows the face of an instrumentation gauge for the liquid cooling system.

These three sensors are connected to a display gauge 130 such as shown in FIG. 9 via suitable intervening electronic signal processing circuitry (not shown in the drawings). The display gauge has a temperature scale on its left side with a corresponding indicator needle driven by the electrical output of the temperature sensor 122. The display gauge also has a coolant pressure scale on its right side with a corresponding indicator needle driven by the electrical output of the coolant system pressure sensor 126. The display gauge also has three LED (Light emitting diodes) indicators 128*a*, 128*b*, 128*c* driven by a circuit such that one LED alarm light (low pump output pressure) is turned on in the event that pump output pressure sensed by sensor 124 falls below a preset trigger point such as 3 or 5 psi, a condition indicative of likely pump malfunction. Another LED alarm light (low coolant indicator) is connected to be turned on in the event that coolant system pressure sensed by sensor 126 falls below e.g. 5 psi at a coolant temperature above 160° F., a condition indicative of possible loss of coolant due to leakage. If even a cup of coolant is lost from the system the resulting gas bubble in the coolant conduits is sufficient to prevent the system pressure from rising above the 5 psi trigger level at a temperature above 160° F. The gauge also provides an adjustment for setting the trigger pressure level. A generally normal system pressure is about 7 psi at a coolant temperature of 160° F. A third LED indicator turns on if the output of temperature sensor 122 indicates a coolant temperature in excess of 260° F., which is 5° F. below the boiling point of the 50:50 coolant mix at a pressure of 15 psi.

In general the coolant temperature provides only a coarse indication of cooling system operation. The indication of pump output pressure and of low system pressure provided by the gauge 126 provides additional critical information which might not be discovered if only coolant temperature is monitored. For example, the pilot may be warned of a low coolant condition or of pump failure on the ground during pre-flight engine run-up which is intended to bring the aircraft's engine to full operating temperature, thereby avoiding a subsequent in-flight emergency. Also an in-flight pump failure is indicated to the pilot immediately prior to noticeable engine temperature rise, giving the pilot invaluable time in which to perhaps reduce engine power to delay overheating and search for a suitable emergency landing site. Under emergency conditions a 30 second delay can be lifesaving.

The entire liquid cooling system adds an estimated 30 pounds of weight to the aircraft, including 3 gallons of coolant, a very reasonable trade-off for a substantial improvement in engine performance and service life. A chief advantage of the liquid cooling system retrofit described above is that the entire retrofit installation of the liquid cooling system can be performed on an existing aircraft without removing the engine from the airframe, i.e. the engine does not have to be taken out and put on a work bench, which greatly reduces the cost of the conversion to liquid cooling. A minimum number of engine parts are changed during the conversion, and in particular, no moving engine parts are changed, so that the proven reliability of the existing engine design is not impacted by the conversion. The liquid cooling system is modular in nature in that conversion of engines of more than four pistons is easily accomplished because each piston cylinder has its own discrete water cooling jacket, so that larger engines simply require the installation of additional jacketed cylinders and manifolds with additional T-fittings 102 and connector tubes 104 as needed for connection to the additional cylinders.

While a preferred embodiment of the invention has been described for purposes of clarity and explanation it will be understood that many changes, substitutions and modifications to the described embodiments will be apparent to those having only ordinary skill in the art without thereby departing from the scope of this invention, which is limited only by the scope of the following claims.

What is claimed as new is:

1. A replacement cylinder for use in providing liquid cooling to an air cooled internal combustion engine of the type having one or more piston cylinders exterior to a crankcase block, said replacement cylinder comprising:

a unitary casting including a cylinder head portion, intake and exhaust ports and spark plug openings in said head portion; said cylinder head having coolant passages therein; and a double walled jacket defining an annular coolant cavity having an open end and an opposite end closed by a head portion having intake and exhaust ports, said head portion including coolant passages in fluidic communication with said annular coolant cavity, a coolant inlet and a coolant outlet on said jacket for circulating coolant through said coolant cavity and said coolant passages;

a flow gate near said coolant inlet for diverting a substantial portion of coolant flow from said inlet into said coolant passages and the balance of the coolant flow into said coolant cavity; and a cylinder sleeve fitted to said open end of said double walled jacket of said unitary casting.

2. The replacement cylinder of claim 1 wherein said cylinder sleeve is threaded to said unitary casting.

3. The replacement cylinder of claim 1 wherein said cylinder sleeve and said unitary casting are made of materials having dissimilar coefficients of thermal expansion and said cylinder sleeve and said unitary casting are fitted to each other in a compressive interference fit by differential thermal expansion.

4. The replacement cylinder of claim 1 wherein said cylinder sleeve and said unitary casting are made of materials having dissimilar coefficients of thermal expansion and said cylinder sleeve and said unitary casting are threaded to each other and permanently joined in fluid tight interference fit resulting from differential thermal contraction during cooling following hot assembly.

5. The replacement cylinder of claim 1 wherein said double walled jacket has an outer wall and an inner wall both joined to said head portion and further joined along a common bottom, said annular coolant cavity being defined between said outer wall and said inner wall, said inner wall being in thermal contact with a substantial portion of said cylinder sleeve such that coolant liquid circulating through said cavity cools said cylinder sleeve without coming into contact with the cylinder sleeve, whereby electrolytic corrosion is avoided between the casting and sleeve of dissimilar metals.

6. The replacement cylinder of claim 1 wherein said coolant inlet and said coolant outlet are diametrically opposite to each other on said annular coolant jacket.

7. The replacement cylinder of claim 1 wherein said flow gate is configured for preferentially diverting coolant entering said inlet into said coolant passages over said annular coolant cavity.

8. The replacement cylinder of claim 1 wherein said casting is of aluminum and said cylinder sleeve is of steel.

9. The engine of claim 1 further comprising flow restrictor means for maintaining a higher coolant pressure in said coolant passages and said annular coolant cavity than in said outlet manifold.

10. The engine of claim 1 further comprising flow restrictor means positioned for restricting coolant outflow from said coolant outlet for substantially increasing coolant pressure in said coolant passages and said annular coolant cavity.

11. The engine of claim 10 wherein said flow restrictor means is interposed between said coolant of each said casting and said outlet manifold.

12. The engine of claim 1 wherein said coolant inlet and said coolant outlet are diametrically opposite on each said unitary cylinder head casting, and said head casting is mounted to said crankcase block for upward flow of coolant from said inlet to said outlet.

13. A liquid cooled internal combustion engine having plural pairs of horizontally opposed pistons, each piston displaceable in a piston cylinder external to a common crankcase block, said piston cylinder having a unitary casting including a double walled jacket defining an annular coolant cavity having an open end and an opposite end closed by a head portion having intake and exhaust ports, said head portion including coolant passages in fluidic communication with said annular coolant cavity and arranged for directing coolant into thermal proximity with said exhaust ports and returning coolant to said annular coolant cavity, and a coolant inlet and a coolant outlet on said jacket for circulating coolant through said coolant cavity and said coolant passages; a cylinder sleeve fitted to said open end of said double walled jacket; a radiator; and a pump directly gear driven by an accessory drive shaft of said engine for circulating coolant liquid through said unitary casting of each said piston cylinder and said radiator thereby to dissipate heat from the piston cylinders to the environment through the radiator; and a cooling system instrumentation display having:

a) a temperature indicator driven by a temperature sensor in thermal contact with said coolant liquid;

b) an actual water pump outlet pressure indicator driven by an input signal representative of the difference between an instantaneous pump outlet pressure and a coolant system pressure measured at a point downstream from the pump and upstream of said engine; and c) a low coolant indicator actuated by a signal representative of a relatively low coolant system pressure coupled with a relatively high coolant temperature.

14. The engine of claim 13 wherein said engine has an accessory pad and an accessory drive shaft on said crankcase block, said pump being mounted to said accessory pad and driven by said accessory drive shaft.

15. The engine of claim 14 wherein said pump further comprises a step-up gear assembly between a rotor of said pump and said accessory drive shaft whereby the pump rotor turns at higher speed than said accessory drive shaft.

16. The engine of claim 13 wherein said point downstream is at a thermostat connected downstream of said pump for controlling coolant flow through or bypassing said radiator.

17. The engine of claim 13 wherein said relatively low coolant system pressure is an adjustable pressure.

18. The engine of claim 13 wherein said relatively low coolant system pressure is a pressure lower than 5 psi and said relatively high coolant temperature is greater than 160° F.

19. The engine of claim 13 wherein said coolant inlet is near a lowermost point along a circumference of said annular coolant cavity and said coolant outlet is near an uppermost point along a circumference of said annular coolant cavity on each of said horizontally opposed pistons, whereby coolant flow through said annular cavity is in a generally upward direction from said coolant inlet to said coolant outlet and convective flow of coolant through said annular cavity is maintained in the event of failure of said pump thereby to delay overheating of the engine.

20. A minimally invasive method of converting to liquid cooling a horizontally opposed piston engine having air cooled finned piston cylinders mounted to a common crankcase block and air cooled cylinder heads on said finned piston cylinders, comprising the steps of:

detaching each said finned piston cylinders from said crankcase block together with said air cooled cylinder heads and substituting therefore a liquid cooled replacement cylinder comprising a unitary casting including a double walled jacket defining an annular coolant cavity having an open end and an opposite end closed by a head portion having intake and exhaust ports, said head portion including coolant passages in fluidic communication with said annular coolant cavity, and a coolant inlet and a coolant outlet on said jacket for circulating coolant through said coolant cavity and said coolant passages, and a cylinder sleeve fitted to said open end of said double walled jacket;

mounting a coolant pump on an accessory pad of said engine and connecting an accessory drive shaft of said accessory pad for driving said pump;

providing a radiator; and interconnecting said pump, said radiator, and said coolant inlet and coolant outlet of each replacement cylinder to make a closed coolant circuit.

21. The method of claim 20 further comprising the step of orienting each said replacement cylinder relative to the crankcase block such that each said coolant inlet is near a lowermost point along a circumference of said annular coolant cavity and each said coolant outlet is near an uppermost point along a circumference of said annular coolant cavity on each of said horizontally opposed pistons, whereby coolant flow through said annular cavity of each replacement piston is in a generally upward direction from said coolant inlet to said coolant outlet and convective flow of coolant through said annular cavity is maintained in the event of failure of said pump to thereby delay overheating of the engine.

22. The method of claim 20 further comprising the step of restricting coolant flow from said coolant outlet for maintaining a substantially higher coolant pressure in said coolant passages and said annular coolant cavity than in an outlet manifold connected to said coolant outlet.

23. The method of claim 22 wherein said step of restricting comprises the step of installing a flow restrictor of reduced aperture downstream of said coolant outlet.

24. The method of claim 23 wherein said flow restrictor comprises a washer of reduced aperture relative to said coolant outlet between said casting and said outlet manifold.

25. A liquid cooled internal combustion engine having plural pairs of horizontally opposed pistons, each piston displaceable in a piston cylinder external to a common crankcase block, said piston cylinder having a unitary casting including a double walled jacket defining an annular coolant cavity having an open end and an opposite end closed by a head portion having intake and exhaust ports, said head portion including coolant passages in fluidic communication with said annular coolant cavity and arranged for directing coolant into thermal proximity with said exhaust ports and returning coolant to said annular coolant cavity, and a coolant inlet and a coolant outlet on said jacket for circulating coolant through said coolant cavity and said coolant passages; a cylinder sleeve fitted to said open end of said double walled jacket; a radiator; and a pump directly gear driven by an accessory drive shaft of said engine for circulating coolant liquid through said unitary casting of each said piston cylinder and said radiator thereby to dissipate heat from the piston cylinders to the environment through the radiator; said engine further having an inlet coolant manifold and an outlet coolant manifold, each said coolant manifold comprising a T-fitting including a center tube attached to each said coolant inlet and coolant outlet, respectively, each said T-fitting having a cross tube open at opposite ends, a ring seal at each of said opposite ends, and a connecting tube inserted into the ring seals of mutually facing open ends of adjacent ones of said piston cylinders, a hose connected to a first one of said cross tube ends and a plug closing a last one of said cross tube ends, one said hose of said inlet manifold connected to an outlet of said pump for delivering coolant to said cylinders, the other said hose of said outlet manifold connected for returning hot coolant to a thermostat, said thermostat connected for directing coolant flow directly to said pump or through a radiator.

26. The engine of claim 25 wherein said T-fittings and said connector tubes are made of aluminum.

27. The engine of claim 25 wherein said ring seals are selected to permit slight movement of a longitudinal axis of said connecting tube away from coaxial relationship with said cross tube without breaking fluid tight sealing.

28. The engine of claim 25 wherein said coolant inlet and said coolant outlet are diametrically opposite on each said unitary cylinder head casting, and said head casting is mounted to said crankcase block for upward flow of coolant from said inlet to said outlet.

29. A liquid cooled internal combustion engine having plural pairs of horizontally opposed pistons, each piston displaceable in a piston cylinder external to a common crankcase block, each said piston cylinder having a unitary cylinder head casting including a double walled jacket defining an annular coolant cavity having an open end and an opposite end closed by a head portion having intake and exhaust ports, said head portion including coolant passages for directing coolant into thermal proximity with said exhaust ports and returning coolant to said annular coolant cavity, a coolant inlet and a coolant outlet on said jacket for circulating coolant through said coolant cavity and said coolant passages, a flow gate arranged for diverting a substantial portion of coolant from said coolant inlet into said coolant passages and a balance of said coolant from said coolant inlet into said annular coolant cavity, and a cylinder sleeve fitted to said open end of said double walled jacket; and an intake manifold and an outlet manifold connected respectively to said coolant inlet and said coolant outlet of each said cylinder head casting.

30. The engine of claim 29 said intake manifold and said outlet manifold comprising a T-fitting including a center tube attached to each said coolant inlet and coolant outlet, respectively, each said T-fitting having a cross tube open at opposite ends, a ring seal at each of said opposite ends, and a connecting tube inserted into the ring seals of mutually facing open ends of T-fittings on adjacent ones of said piston cylinders, a hose connected to a first one of said cross tube ends and a plug closing a last one of said cross tube ends, one said hose of said inlet manifold connected to an outlet of a coolant pump for delivering coolant to said cylinders, the other said hose of said outlet manifold connected for returning hot coolant to a thermostat, said thermostat connected for directing coolant flow directly to said pump or through a radiator.

31. The engine of claim 30 wherein said T-fittings and said connector tubes are made of aluminum whereby said inlet manifold and said outlet manifold are relatively lightweight.

32. The engine of claim 30 wherein said ring seals are selected to permit slight movement of a longitudinal axis of said connecting tube away from coaxial relationship with said cross tube without breaking fluid tight sealing.

33. The engine of claim 30 wherein each said manifolds has seals between said T-fittings and said connector tubes and said seals are selected to permit slight angular movement of said connector tubes relative to said T-fittings without breaking fluid tight sealing therebetween.

34. The engine of claim 29 wherein said coolant inlet and said coolant outlet are diametrically opposite on each said unitary cylinder head casting, and said head casting is mounted to said crankcase block for upward flow of coolant from said inlet to said outlet.

35. A liquid cooled internal combustion engine having one or more piston cylinders exterior to a crankcase block, each of said cylinders comprising a unitary casting including a cylinder head portion, intake and exhaust ports, spark plug openings and coolant passages in said head portion; a double walled jacket defining an annular coolant cavity having an open end and an opposite end closed by a head portion having intake and exhaust ports, a coolant inlet and a coolant outlet on said casting for circulating coolant through said coolant cavity and said coolant passages, and a cylinder sleeve fitted to said open end of said double walled jacket of said casting, said cylinder sleeve being mounted to said crankcase block;

said coolant inlet and said coolant outlet of each said casting being connected in parallel to an intake manifold and an outlet manifold respectively, each said manifold being exterior to said cylinders.

36. The engine of claim 35 wherein said casting has a flow gate near said coolant inlet for diverting a substantial portion of coolant from said coolant inlet into said coolant passages and a balance of said coolant from said coolant inlet into said annular coolant cavity.

37. The engine of claim 36 wherein said flow gate is configured for preferentially diverting coolant into said coolant passages over said annular coolant cavity.

38. The engine of claim 35 wherein said coolant inlet and said coolant outlet are diametrically opposite to each other on said jacket.

39. The engine of claim 35 wherein each of said manifolds comprises T-fittings and connector tubes made of aluminum whereby said inlet manifold and said outlet manifold are relatively lightweight.

40. The engine of claim 39 each said T-fitting including a center tube attached to a said coolant inlet or coolant outlet, each said T-fitting having a cross tube open at opposite ends, and said seals comprise a ring seal at each of said opposite ends, a connector tube being inserted into the ring seals of mutually facing open ends of adjacent ones of said piston cylinders.

41. The engine of claim 35 further comprising flow restrictor means for maintaining a higher coolant pressure in said coolant passages and said annular coolant cavity than in said outlet manifold.

42. A replacement cylinder for use in providing liquid cooling to an air cooled internal combustion engine of the type having one or more piston cylinders exterior to a crankcase block, said replacement cylinder comprising:

a unitary casting including a cylinder head portion, intake and exhaust ports and spark plug openings in said head portion; said cylinder head having coolant passages therein; and a double walled jacket defining an annular coolant cavity having an open end and an opposite end closed by a head portion having intake and exhaust ports, said head portion including coolant passages in fluidic communication with said annular coolant cavity, a coolant inlet and a coolant outlet diametrically opposite to each other on said jacket for circulating coolant through said coolant cavity and said coolant passages;

a flow gate near said coolant inlet for diverting a substantial portion of coolant flow from said inlet into said coolant passages and the balance of the coolant flow into said coolant cavity;

a flow restrictor for maintaining a relatively high coolant pressure in said coolant passages and said annular coolant cavity; and a cylinder sleeve fitted to said open end of said double walled jacket of said unitary casting.

* * * * *